US009719317B2

(12) United States Patent
Thomas

(10) Patent No.: US 9,719,317 B2
(45) Date of Patent: Aug. 1, 2017

(54) DOWNHOLE FISHING TOOL

(71) Applicant: THOMAS DRILLING, Afton, WY (US)

(72) Inventor: Tyson Thomas, Afton, WY (US)

( * ) Notice: Subject to any disclaimer, the term of this patent is extended or adjusted under 35 U.S.C. 154(b) by 471 days.

(21) Appl. No.: 14/302,272

(22) Filed: Jun. 11, 2014

(65) Prior Publication Data

US 2015/0361752 A1 Dec. 17, 2015

(51) Int. Cl.
*E21B 31/18* (2006.01)

(52) U.S. Cl.
CPC ..... *E21B 31/18* (2013.01)

(58) Field of Classification Search
CPC combination set(s) only.
See application file for complete search history.

(56) References Cited

U.S. PATENT DOCUMENTS 1,443,853 A * 1/1923 Stephens ..... E21B 31/18 24/136 R
1,454,819 A * 5/1923 Jones ..... E21B 29/007 166/55.6
2,759,757 A 8/1956 Pace
4,444,528 A 4/1984 Scodino et al.
4,445,804 A 5/1984 Abdallah et al.
5,044,827 A 9/1991 Gray et al.
5,178,429 A 1/1993 Gray et al.
8,496,058 B2 7/2013 Davis
2013/0032348 A1 2/2013 Puccio

* cited by examiner

*Primary Examiner* — David Andrews
*Assistant Examiner* — Ronald Runyan
(74) *Attorney, Agent, or Firm* — Frank J. Dykas; Dykas Law Offices, PLLC

(57) ABSTRACT

A fishing tool is provided to enable retrieval of a fish from a mineral extraction system. The downhole fishing tool includes a frustoconical member for guiding broken fish such as a broken pipe into a channel created by a sliding car and an edge of a body of the downhole fishing tool. The channel enlarges by sliding the sliding car along the body of the downhole fishing tool. The downhole fishing tool body and sliding car are aligned such that the sliding car slides diagonally across the body of the downhole fishing tool thus creating a larger channel at a first point along the diagonal than at a second point along the diagonal.

7 Claims, 5 Drawing Sheets

DOWNHOLE FISHING TOOL

TECHNICAL FIELD

The presently disclosed and claimed inventive concept(s) generally relate to an apparatus and method for removing fish from a mineral extraction system, and more particularly to removing fish using a clamping mechanism from a mineral extraction well using a clamping mechanism.

BACKGROUND

As is well understood in society, oil and natural gas play a very important role in the development of both the United States economy and the global economy. Devices and systems that depend on oil and natural gas are found throughout society. In order to mine these resources, a significant amount of time and money is being spent in locating and extracting oil, natural gas, and other subterranean resources from the earth. This includes both onshore and offshore drilling depending on the location of the resource. The extraction systems generally include a wellhead assembly through which the resource is extracted. The wellhead assembly may include a variety of components. These components include a variety of casings, valves, fluid conduits, etc., that control the extraction and drilling operations.

A variety of materials may be inserted into or removed from a well. These include transporting drilling fluid into the well, providing pipes to allow drilling fluids, mud, and cuttings to flow up from the well, drill pipes connecting to a drill bit or other tool at the end of the well, or a riser that may be coupled to a blow out preventer that can seal off the well in certain situations.

During the drilling operations a pipe or other material may break within the well either due to accidental breakage or due to the need to seal off the well under an emergency. This may involve the blowout preventer bending, cutting, shearing or otherwise deforming the drill pipe or other components in the wellhead. These components that are left within the wellhead are referred to as fish. Retrieval of the fish through "fishing" may be challenging, time consuming and expensive. Accordingly, what is needed is an efficient method to remove the fish from a well casing.

SUMMARY OF THE DISCLOSURE

The purpose of the summary is to enable the public, and especially the scientists, engineers, and practitioners in the art who are not familiar with patent or legal terms or phraseology, to determine quickly from a cursory inspection, the nature and essence of the technical disclosure of the application. The summary is neither intended to define the inventive concept(s) of the application, which is measured by the claims, nor is it intended to be limiting as to the scope of the inventive concept(s) in any way.

What is disclosed is a downhole fishing tool for removing a fish, for example a pipe, from a shaft in which mineral extraction from the earth occurs. This mineral extraction includes, for example, oil drilling. In a preferred embodiment, the downhole fishing tool has a body, having a first side located between a sliding car attached to the body. The term pipe is used to denote a pipe to be fished from a mineral extraction system or to denote any other fish that may need to be extracted. The body and the sliding car form a channel between the sliding car and the body. This channel is configured for a pipe to enter into the channel between the body and the sliding car. The sliding car is slidably attached to the body of the downhole fishing tool such that the channel between the sliding car and the body of the downhole fishing tool becomes larger or smaller as the sliding car slides in one direction or the other along the body of the downhole fishing tool. The channel is configured to retain a pipe or other fish when a pipe is clamped between the downhole fishing tool body and the sliding car. The clamping mechanism occurs utilizing a force to move the downhole fishing tool sliding car along the body to narrow the channel formed between the downhole fishing tool body and the sliding car. There can be teeth in between the sliding car and the body to engage a pipe when it is clamped into the downhole fishing tool.

A variety of forces could potentially be used to clamp the downhole fishing tool onto a pipe. In one embodiment, the downhole fishing tool is lowered into a well casing such that the sliding car is biased in the second position in which the channel formed by the sliding car and the body is at a narrow point in relation to the overall potential of the opening size of the channel. In this position, the sliding car is biased via gravity to a low point along the channel. As the downhole fishing tool apparatus is lowered onto a fish, the fish, for example, a pipe, forces the sliding car upward and widens the channel formed by the sliding car and the body of the downhole fishing tool. When the channel is sufficiently large enough for the fish to enter the channel, the sliding car slides downward under the force of gravity to clamp the fish into the channel.

In alternative embodiments, it is conceived that a hydraulically or mechanically activated mechanism could displace or force the sliding car down onto the fish in the clamped position.

Embodiments of the downhole fishing tool are generally attached to a pipe or similar mechanism for lowering the downhole fishing tool into a well casing or otherwise directing the downhole fishing tool into a well casing or other mineral extracting system. In a preferred embodiment, the downhole fishing tool is threadedly attached to the guide or other tool.

In a preferred embodiment, the downhole fishing tool has a fish guide to guide fish into the channel formed between the sliding car and the downhole fishing tool body. In a preferred embodiment, this fish guide is a generally cylindrical section having a frustoconical void in the cylindrical shape. The apex of the frustoconical shape is a channel aligned with the channel formed by the sliding car and the body such that a fish enters into the base of the frustoconical shape and the frustoconical shape guides the fish into the channel between the sliding car and the body of the downhole fishing tool as the downhole fishing tool is lowered or directed toward a fish. Subsequently the fish enters into the channel between the sliding car and the body of the downhole fishing tool.

In a preferred embodiment, the pipe guide can have a second channel that is used to position the downhole fishing tool onto a non broken pipe in a well casing. This can be used to direct the downhole fishing tool downward or into a well casing. In a preferred embodiment, this channel is generally parallel to the channel formed by the sliding car and the body of the downhole fishing tool. This allows the pipe to guide the downhole fishing tool downward into the well casing and along the pipe. In a preferred embodiment, the sliding car is a generally u-shaped apparatus that is attached in a channel to the body of the downhole fishing tool. The sliding car is configured to slide along the channel from a first point to a second point in which the first point and the second point create different widths of the channel between the sliding car and the body of the downhole fishing tool. In this embodiment, the downhole fishing tool can have a body that takes a generally rectangular cuboid shape. The track extends the width of the rectangular cuboid shape between two opposite faces of the rectangular cuboid. The generally u-shaped sliding car has two arms that form the arms of the u as well as a trough that forms the u-shape. The arms of the sliding car are then connected by rollers which roll or slide along the track as the sliding car travels along the body of the downhole fishing tool.

What is also disclosed is a method of using the downhole fishing tool to remove a pipe from a well casing. The method of removing the fish, or in the depicted embodiment a pipe, from a well casing is to lower the downhole fishing tool attached to a guide mechanism into a well casing. As the downhole fishing tool approaches the fish, as depicted in the illustrations a broken pipe, the fish enters into the frusto-conical void and subsequently is guided toward the channel between the sliding car and the body of the downhole fishing tool. As the fish enters into this channel, the fish displaces the sliding car upward until the channel between the sliding car and the body of the downhole fishing tool is sufficiently wide enough for the fish to enter the channel. At this point, the sliding car drops onto the fish and clamps the fish into the downhole fishing tool. After the fish is clamped into the downhole fishing tool, the downhole fishing tool is removed from the well casing taking the fish or pipe with it.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE EXEMPLARY EMBODIMENTS

Figure 1:
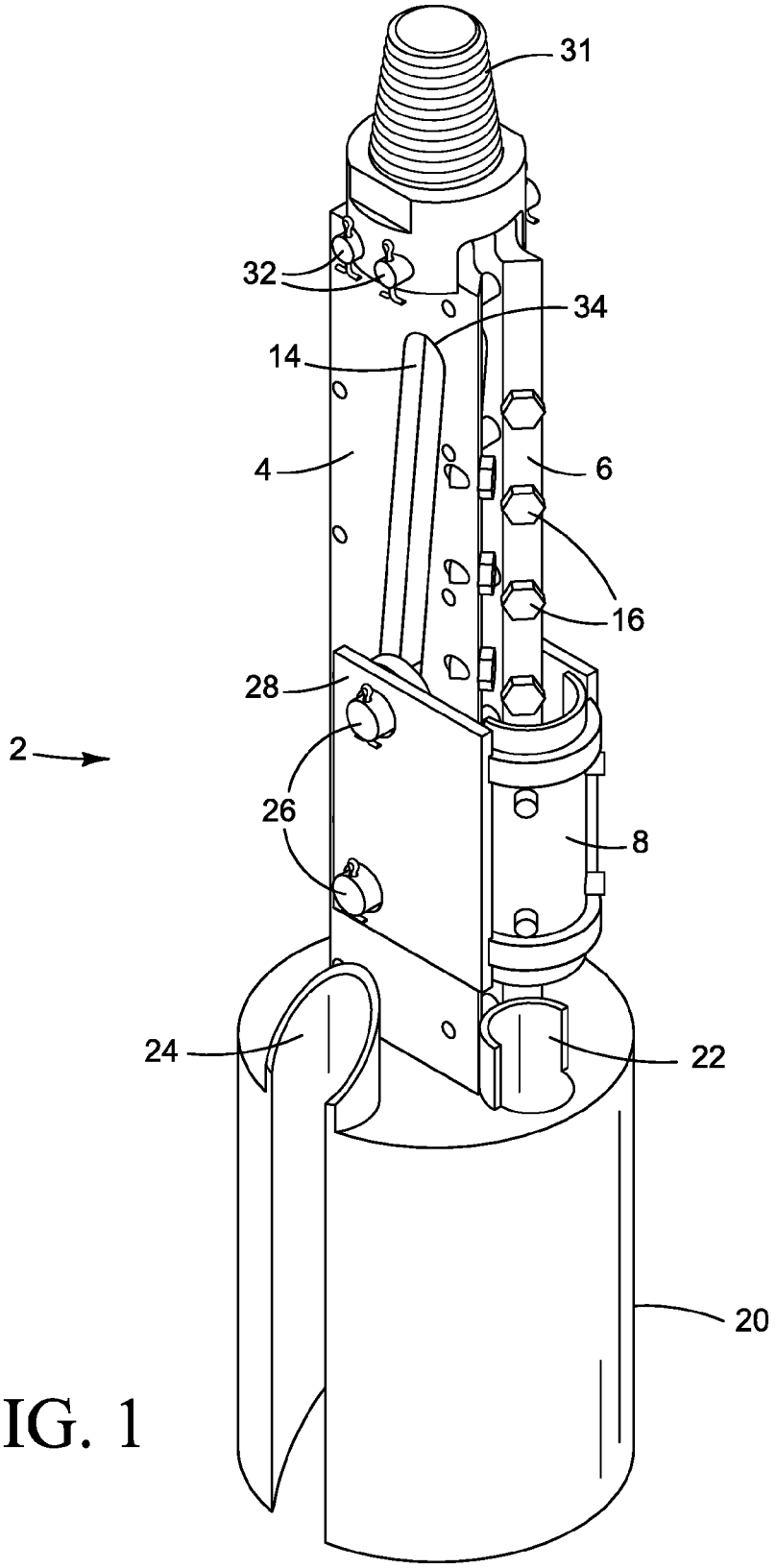
FIG. 1 illustrates a perspective view of an embodiment of the downhole fishing tool.

FIG. 1 illustrates a perspective view of the downhole fishing tool 2. The downhole fishing tool 2 has a generally rectangular cuboid body 4. Sliding car 28 travels along track 14 from the top 34 of the track 14 to the bottom (hidden by sliding car 28) of the track 14. Sliding car 28 has curved section 8 that in conjunction with the first edge 6 of the body 4 of the downhole fishing tool 2 creates a channel for a pipe to be secured in between the sliding car 28 and the first edge 6 of the body 4. Rails 26 span the width of the body 4 in the track 14 and slide along the track 14. Rails 26 comprise spacers 16 to provide for alignment of the sliding car 28 in relation to the body 4 of the downhole fishing tool 2 and the sliding car 28.

In the depicted embodiment, the downhole fishing tool 2 has an attachment mechanism 31 for attaching the downhole fishing tool 2 to a tool or a pipe for lowering or directing the downhole fishing tool 2 into a well casing. In a preferred embodiment, the attachment mechanism 31 is connected to the body 4 of the downhole fishing tool 2 such that the attachment mechanism 31 is removable. In the depicted embodiment, pins 32 connect the attachment mechanism 31 to the body 4. The attachment mechanism 31 in the depicted embodiment is configured for threaded engagement with a tool or pipe (not shown) utilized for lowering or directing the downhole fishing tool 2 into a well casing.

In use, the downhole fishing tool 2 contains a pipe guide section 20 attached to or part of the body 4. The pipe guide 20, in a preferred embodiment, contains guide 22 for positioning the downhole fishing tool 2 onto an unbroken pipe 60 such that the downhole fishing tool 2 slides along the unbroken pipe 60. The pipe guide 20 also functions to guide a broken section of pipe 56 into the channel formed by sliding car 28 and the edge of the body 6 by guiding the broken pipe section 56 through the guide 22 and into the channel.

As depicted in the following figures, when a broken pipe section enters into the channel, in a preferred embodiment the broken pipe section pushes the sliding car 28 upwards such that sliding car 28 slides along track 14. Track 14 is angled such that the sliding car 28 is closer at a first point than at a second point. When the sliding car 28 is closer to the body 4 at the first point, the channel created by the U-shaped section 8 of the sliding car 28 is narrower than when the sliding car 28 is at a point distal to the pipe guide 22. At this distal point, the sliding car 28 is positioned proximate to point 34 where it is depicted in FIG. 1. The broken pipe or fish displaces U-shaped section 8 of the sliding car 28 upwards, when the downhole fishing tool 2 is in a vertical orientation as depicted in FIG. 1. When the broken pipe has pushed the sliding car 28 such that the channel is large enough that the pipe can fit into the channel created between the sliding car 28 and the body 4 of the downhole fishing tool 2, the sliding car 28 slides downward along the channel, thus clamping the broken pipe into a retained or clamped position. The downhole fishing tool 2 can then either be raised up out of the well casing or pulled out of the well casing such that the broken pipe is pulled along with the downhole fishing tool 2. This function is described in more detail in the following figures.

Figure 2:
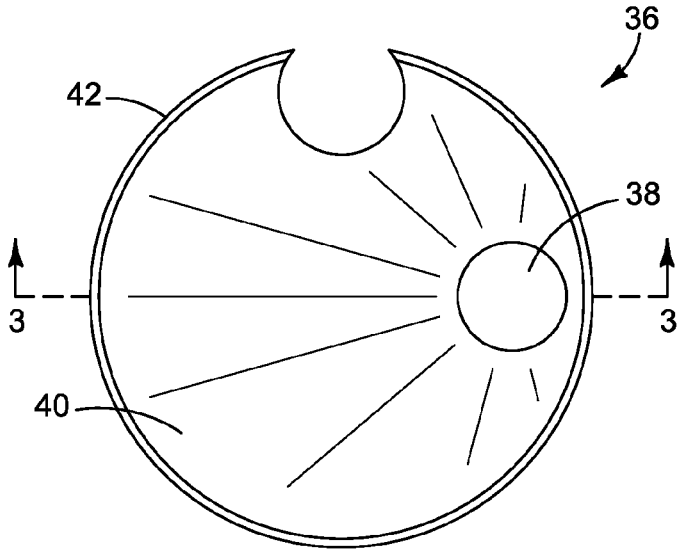
FIG. 2 illustrates a bottom view of an embodiment of the pipe guide of the downhole fishing tool.
Figure 3:
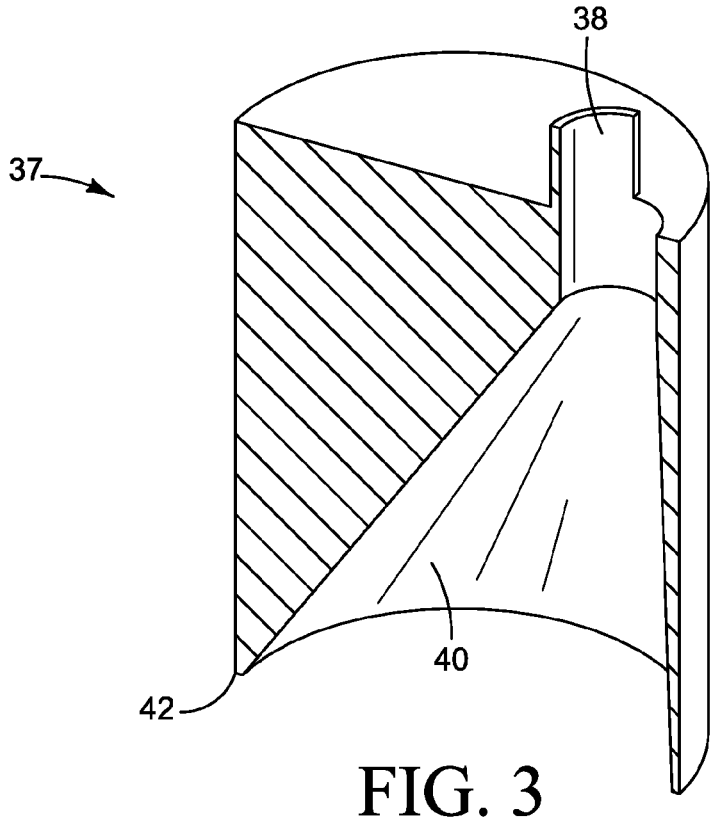
FIG. 3 illustrates a cross section along line 3 of the bottom view of the pipe guide of the downhole fishing tool of FIG. 2.

FIGS. 2 and 3 illustrate views of the fish guide 36, 37 in a preferred embodiment. FIG. 2 illustrates a bottom view of the fish guide 36. FIG. 3 illustrates a cross-section of the fish guide 37 as viewed along cross-section line 3 of FIG. 2. Fish guide 36, 37 comprises a generally frustoconical void 40 in the generally cylindrical shape of the fish guide 36, 37 having base circumference 42 into which a fish is directed. Opening in the apex 38 of the fish guide 36, 37 guides a fish into the channel between the sliding car and the body of the downhole fishing tool. Frustoconical shape 40 guides the fish from the generally open circumference 42 of the base of the fish guide 36, 37 into the apex 38 of the pipe frustoconical void 40 of the fish guide 36, 37 and into the channel formed by the sliding car and the first edge of the body of the downhole fishing tool. Opening guides the downhole fishing tool along an unbroken pipe in the well casing and toward the broken pipe section. FIG. 3 depicts the cross-sectional view of the fish guide 37 along cross-sectional line 3 of FIG. 2. Frustoconical void 40 having outer circumference 42 synonymous with the outer circumference 42 of the cylinder of the generally cylindrical shape of the fish guide 36, 37 guides the broken pipe towards the apex of the frustoconical void and into the channel depicted in FIG. 1.

Figure 4:
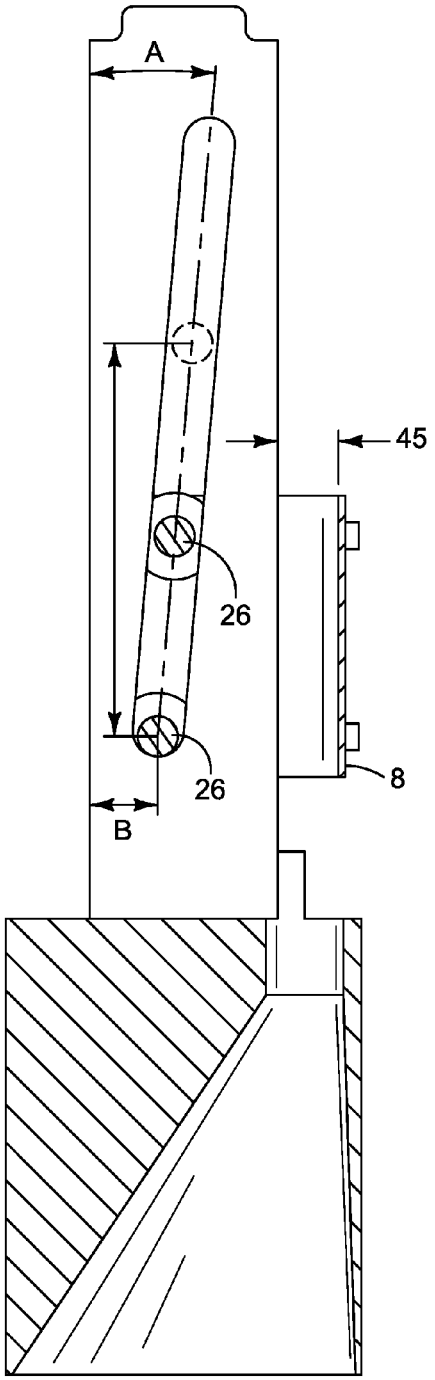
FIG. 4 illustrates a side view of the downhole fishing tool illustrating the lateral movement of the sliding car in relation to the body of the downhole fishing tool.
Figure 5:
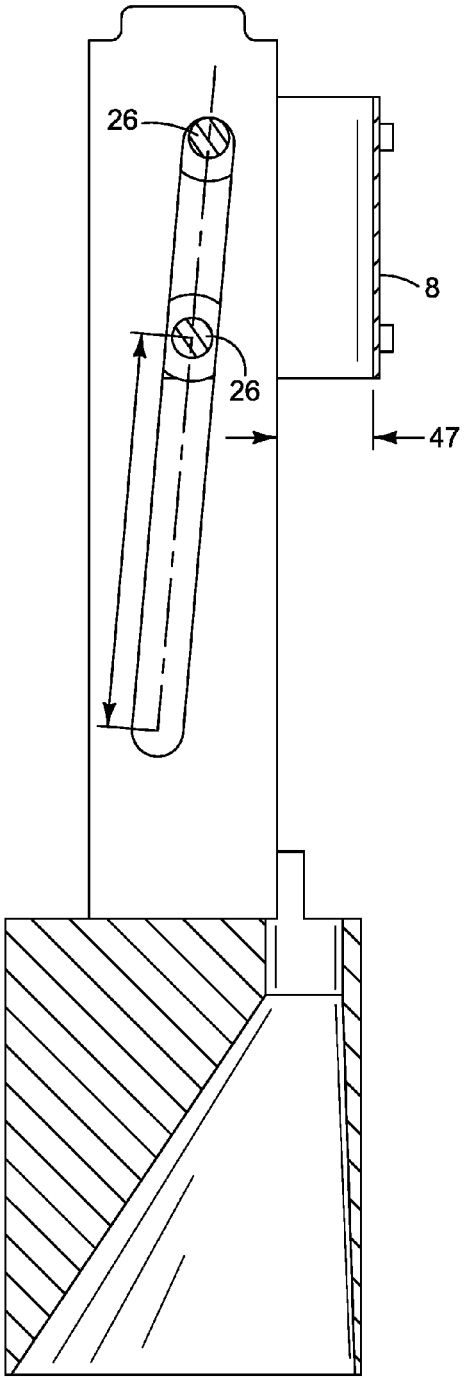
FIG. 5 illustrates a side view of the downhole fishing tool illustrating the lateral movement of the sliding car in a second position in relation to the body of the downhole fishing tool.

FIGS. 4 and 5 illustrate the clamping mechanism of the sliding car 8 in conjunction with the body of the downhole fishing tool. FIG. 4 illustrates the sliding car 8 at a first position, or lowered position. In FIG. 4 the sliding car position is at a position in relation to the body of the downhole fishing tool such that the channel is at its narrowest size. In FIG. 5, sliding car 8 is at a further distance in relation to the body of the downhole fishing tool. This distance 47, is such that a pipe or fish can slide into the channel created between the sliding car 8 and the body of the downhole fishing tool. The sliding car 8 slides from the position depicted in FIG. 4 to the position depicted in FIG. 5 thus creating a larger channel as depicted by distances 45, 47. The vertical distance travelled by the sliding car 8 is depicted in that the lower rail 26 of the sliding car 8 travels vertically from the position of FIG. 4 to the position depicted in FIG. 5. The vertical travel of the car also allows the sliding car 8 to travel to generate the distance variations 45, 47 as depicted between FIG. 4 and FIG. 5.

Figure 6:
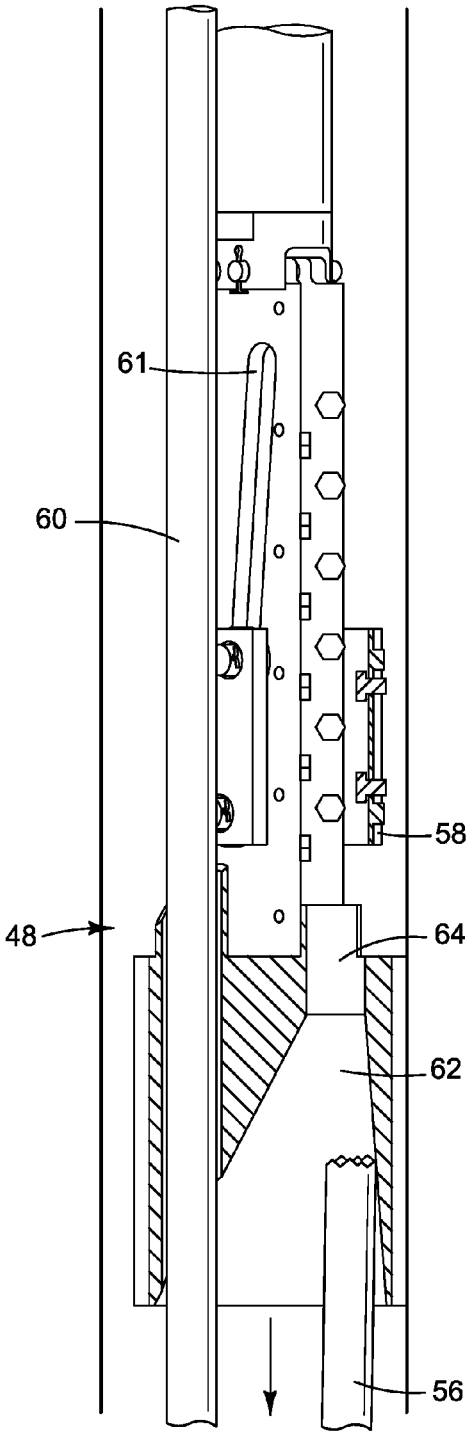
FIG. 6 illustrates a side view of the downhole fishing tool within a casing of a mineral extraction system extracting fish from the casing.
Figure 7:
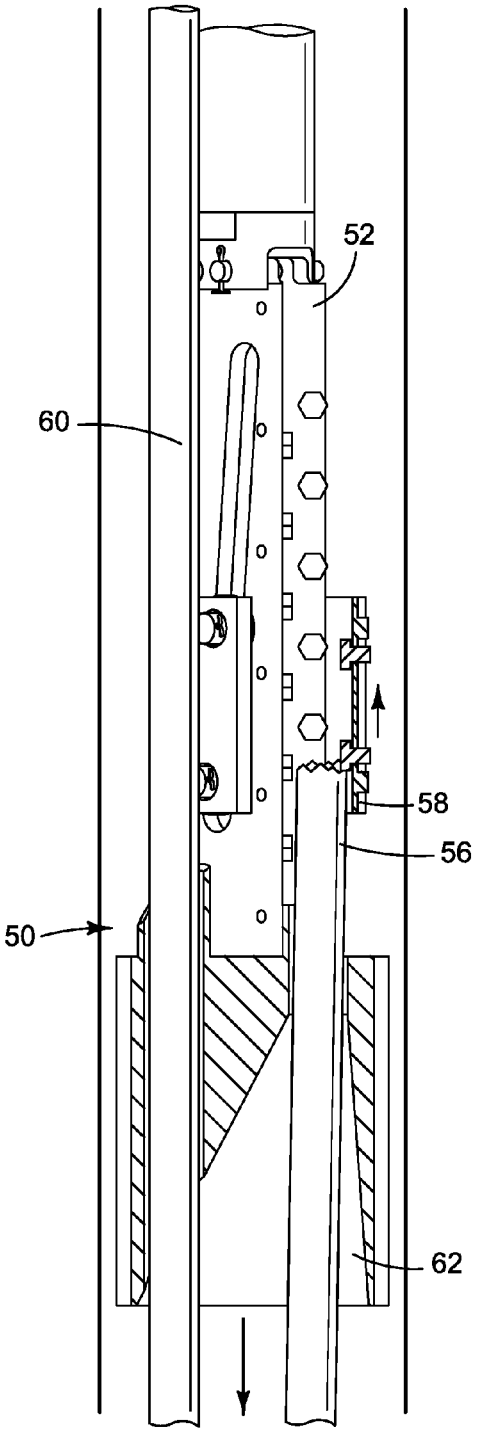
FIG. 7 illustrates a second progressive view of the downhole fishing tool within a casing of a mineral extraction system extracting fish from the casing.

FIGS. 6 through 9 depict a process or method of the downhole fishing tool in operation within a well casing 48, 50, 51, 53. In the depicted embodiment, downhole fishing tool is lowered within the well casing 48, 50, 51, 53 toward a broken pipe 56. Unbroken pipe 60 is used as a guide within opening 24 (as depicted in previous figures) toward the broken fish section 56. The broken fish section 56 is being directed in fish guide 62 toward the apex 64 of the frustoconical void and into the channel formed by the sliding car 58 and the first edge 52 of the body of the downhole fishing tool. The sliding car 58 is at a first position in which the sliding car 58 is at a point closest to the fish guide 62. In FIG. 7, broken pipe 56 is pushing sliding car 58 upwards away from the first point such that the channel between the sliding car 58 and the first edge of the channel 52.

Figure 8:
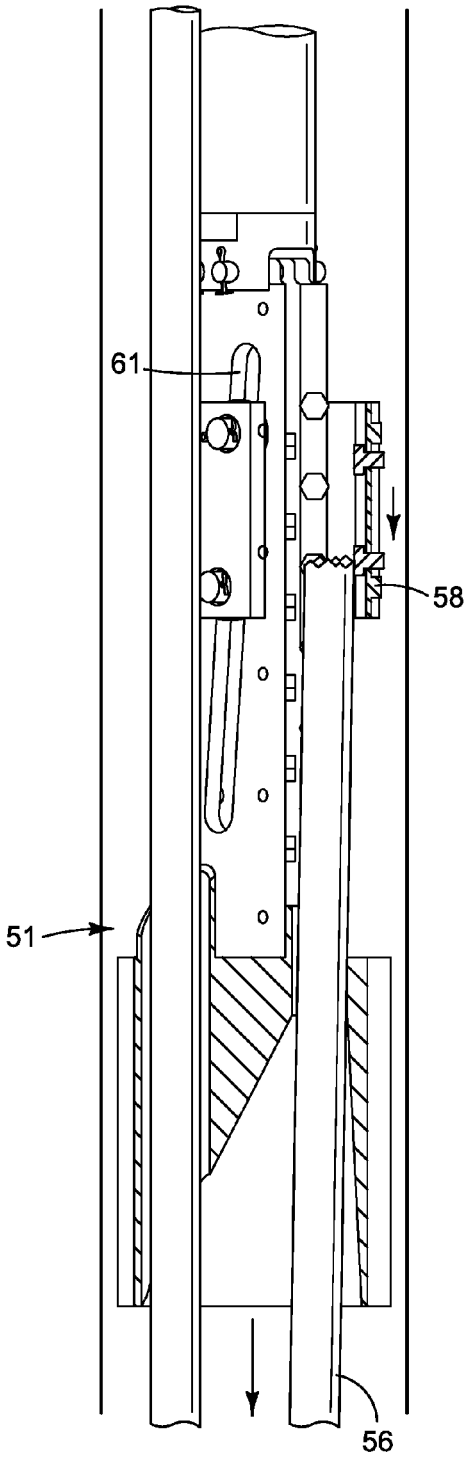
FIG. 8 illustrates a third progressive view of the downhole fishing tool within a casing of a mineral extraction system extracting fish from the casing.
Figure 9:
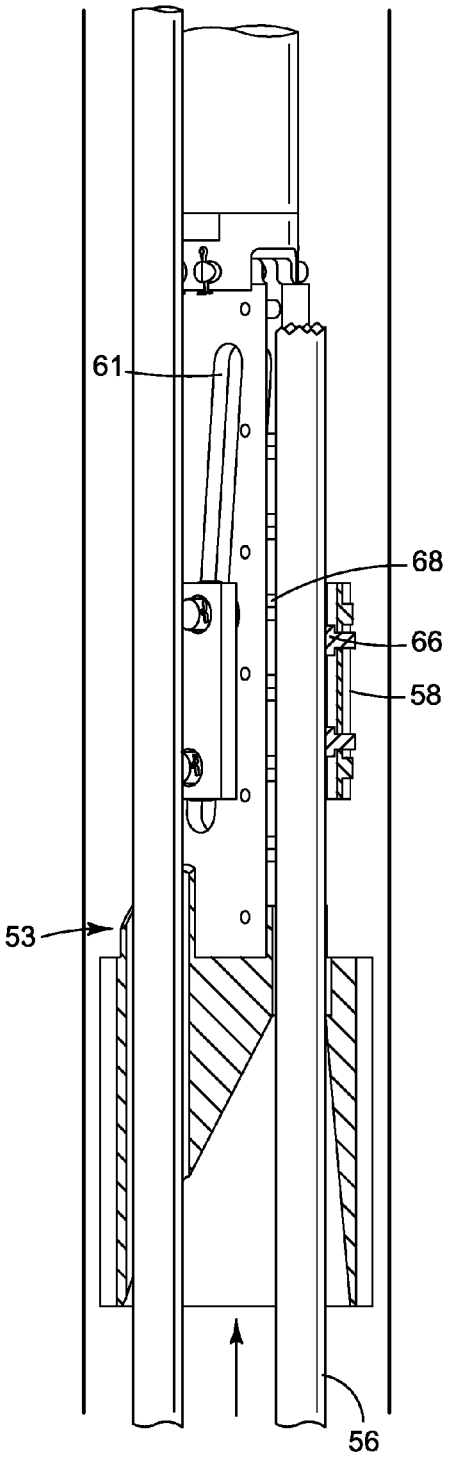
FIG. 9 illustrates a fourth progressive view of the downhole fishing tool within a casing of a mineral extraction system extracting fish from the casing.

FIG. 8 depicts the sliding car 58 at a second position at which the broken pipe 56 is able to fit within the channel between the sliding car 58 and the first edge 52 of the body of the downhole fishing tool. The sliding car 58 is sliding downward as depicted by the arrow along the pipe to a point at which the pipe is clamped into the channel between the sliding car 58 and the body of the fish guide 62. The sliding car tracks are sliding along the channel 61 toward the first position as depicted in FIG. 6. When the sliding car 58 clamps the pipe into a clamped position as depicted in FIG. 9, the sliding car 58 can then be raised or extracted along with the pipe that is clamped into the downhole fishing tool apparatus. The teeth 66, 68 of the body of the downhole fishing tool apparatus and the sliding car 58 were to frictionally engage the pipe such that the pipe is retained within the channel created by the sliding car 58 and the downhole fishing tool apparatus body.

While certain exemplary embodiments are shown in the Figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

The invention claimed is:

1. A downhole fishing tool, said downhole fishing tool comprising:

a body, wherein said body comprises a first side configured for engagement with a fish, and wherein said body comprises a first end and a second end, wherein said second end comprises a fish guide, wherein said fish guide is configured to guide broken fish into a channel formed by a sliding car and said body when said downhole fishing tool is directed toward said broken fish; and wherein said sliding car is slideably attached to said body, wherein said sliding car and said body are connected to form said channel between said first side of said body and a portion of said sliding car, wherein said channel is configured to receive a fish, wherein said sliding car is configured to slide on said body from a first point to a second point such that said channel formed by said body and said sliding car is smaller at said second point than at said first point such that said channel is configured to accept a fish into said channel when said sliding car is at said first point and said sliding car and said body are configured to clamp said fish in said channel when said sliding car is at said second point and wherein said fish guide comprises a guide channel, wherein said guide channel in a plane running generally parallel to said channel formed by said sliding car and said body such that said downhole fishing tool is configured to slide along a non-broken guide fish proximate to a broken fish being fished from a hole.

2. The downhole fishing tool of claim 1, wherein said body comprises a generally rectangular cuboid, having a track which extends a width of said rectangular cuboid between two opposite faces of said rectangular cuboid, wherein said sliding car comprises a generally U shape, wherein said U shape comprises a trough and two arms, wherein said trough and said first edge of said body comprise said channel, wherein said arms of said sliding car are connected by sliding connectors spanning between said arms and located within said track.

3. A downhole fishing tool, said downhole fishing tool comprising:

a body, wherein said body comprises a first side configured for engagement with a fish, wherein said body comprises a generally rectangular cuboid, wherein said rectangular cuboid body comprises a track for slideable engagement with a sliding car; and a sliding car, wherein said sliding car is slideably attached to said body in said track, wherein said sliding car and said body are connected to form a channel between said first side of said body and a portion of said sliding car, wherein said sliding car comprises a generally U shape, wherein said U shape comprises a trough and two arms, wherein said trough and said first edge of said body comprise said channel, wherein said arms of said sliding car are connected by sliding connectors spanning between said arms and located within said track; wherein said channel is configured to receive a fish, wherein said sliding car is configured to slide on said body from a first point to a second point such that said channel formed by said body and said sliding car is smaller at said second point than at said first point such that said channel is configured to accept a fish into said channel when said sliding car is at said first point and said sliding car and said body are configured to clamp said fish in said channel when said sliding car is at said second point.

4. The downhole fishing tool of claim 3, wherein said body comprises a first end and a second end, wherein said second end comprises a fish guide, wherein said fish guide is configured to guide broken fish into said channel formed by said sliding car and said body when said downhole fishing tool is directed toward said broken fish.

5. The downhole fishing tool of claim 4, wherein said fish guide comprises a cylindrical shape, wherein said fish guide comprises a frustoconical void in said cylindrical fish guide wherein said apex of said frustoconical shape comprises a channel aligned with said channel formed by said sliding car and said body such that said downhole fishing tool is configured such that when said downhole fishing tool is directed onto a fish, said fish is guided through a base of said frustoconical void in said fish guide through said apex of said frustoconical void and into said channel formed by said sliding car and said body.

6. The downhole fishing tool of claim 5, wherein said fish guide comprises a guide channel, wherein said guide channel in a plane running generally parallel to said channel formed by said sliding car and said body such that said downhole fishing tool is configured to slide along a non-broken guide fish proximate to a broken fish being fished from a hole.

7. The downhole fishing tool of claim 3, wherein said channel comprises teeth for engaging a fish when a fish is clamped in said channel.

* * * * *